US007748839B2

(12) United States Patent
Noe et al.

(10) Patent No.: US 7,748,839 B2
(45) Date of Patent: Jul. 6, 2010

(54) HANDHELD PRINTING WITH REFERENCE INDICIA

(75) Inventors: Gary Lee Noe, Lexington, KY (US); William Henry Reed, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 1048 days.

(21) Appl. No.: 11/382,286

(22) Filed: May 9, 2006

(65) Prior Publication Data

US 2007/0263062 A1 Nov. 15, 2007

(51) Int. Cl.
*B41J 3/36* (2006.01)

(52) U.S. Cl. ..... 347/109

(58) Field of Classification Search ..... 347/109
See application file for complete search history.

(56) References Cited

U.S. PATENT DOCUMENTS

| | | | |
|---|---|---|---|
| 4,675,700 | A | 6/1987 | Nagira et al. |
| 4,758,849 | A | 7/1988 | Piatt et al. |
| 4,915,027 | A | 4/1990 | Ishibashi et al. |
| 4,933,867 | A | 6/1990 | Ishigaki |
| 4,942,621 | A | 7/1990 | Angwin |
| 4,947,262 | A | 8/1990 | Yajima et al. |
| 4,949,283 | A | 8/1990 | Yamauchi et al. |
| 4,949,391 | A | 8/1990 | Faulkerson et al. |
| RE33,425 | E | 11/1990 | Nihei |
| 4,999,016 | A | 3/1991 | Suzuki et al. |
| 5,013,895 | A | 5/1991 | Iggulden et al. |
| 5,024,541 | A | 6/1991 | Tsukada et al. |
| 5,028,934 | A | 7/1991 | Kasai et al. |
| 5,052,832 | A | 10/1991 | Akiyama et al. |
| 5,063,451 | A | 11/1991 | Yanagisawa et al. |
| 5,093,675 | A | 3/1992 | Koumura et al. |
| 5,110,226 | A | 5/1992 | Sherman et al. |
| 5,111,216 | A | 5/1992 | Richardson et al. |
| 5,149,980 | A | 9/1992 | Ertel et al. |
| 5,160,943 | A | 11/1992 | Pettigrew et al. |
| 5,181,521 | A | 1/1993 | Lemelson |
| 5,184,907 | A | 2/1993 | Hamada et al. |
| 5,186,558 | A | 2/1993 | Sherman et al. |
| 5,188,464 | A | 2/1993 | Aaron |
| 5,236,265 | A | 8/1993 | Saito et al. |
| 5,240,334 | A | 8/1993 | Epstein et al. |
| 5,262,804 | A | 11/1993 | Petigrew et al. |
| 5,267,800 | A | 12/1993 | Petteruti et al. |
| 5,308,173 | A | 5/1994 | Amano et al. |
| 5,311,208 | A | 5/1994 | Burger et al. |
| 5,312,196 | A | 5/1994 | Hock et al. |
| 5,344,248 | A | 9/1994 | Schoon et al. |

(Continued)

*Primary Examiner*—Hai C Pham

(57) ABSTRACT

Methods and apparatus include a handheld printer manipulated back and forth by an operator during use to print an image on a media. The media includes reference indicia upon which users maneuver the printer whenever a location of the printer is unknown or needs updating or validating. A controller of the printer correlates the location of a printhead to the image and when lost communicates to a direction indicator to provide user notification of where to move the housing to reacquire the location. Embodiments of the reference indicia include guide and location patterns, with the guide pattern pointing to the location pattern. Other indicia include related tick marks of substantially equal size and shape with substantially equal spacing there between. Supply items for applying on the media include a substrate with reference indicia thereon that matches stored reference indicia in the printer.

15 Claims, 8 Drawing Sheets

U.S. PATENT DOCUMENTS 5,355,146 A 10/1994 Chiu et al.
5,446,559 A 8/1995 Birk
5,449,238 A 9/1995 Pham et al.
5,462,375 A 10/1995 Isobe et al.
5,475,403 A 12/1995 Havlovick et al.
5,488,675 A 1/1996 Hanna
5,501,535 A 3/1996 Hastings et al.
5,503,483 A 4/1996 Petteruti et al.
5,520,470 A 5/1996 Willett
5,578,813 A 11/1996 Allen et al.
5,581,629 A 12/1996 Hanna et al.
5,593,236 A 1/1997 Bobry
5,634,730 A 6/1997 Bobry
5,644,139 A 7/1997 Allen et al.
5,650,820 A 7/1997 Sekine et al.
5,685,651 A 11/1997 Hayman et al.
5,729,008 A 3/1998 Blalock et al.
5,786,804 A 7/1998 Gordon
5,806,993 A 9/1998 Petteruti et al.
5,816,718 A 10/1998 Poole
5,825,044 A 10/1998 Allen et al.
5,825,995 A 10/1998 Wiklof et al.
5,829,893 A 11/1998 Kinoshita et al.
5,842,793 A 12/1998 Katayama et al.
5,848,848 A 12/1998 St. Jean
5,848,849 A 12/1998 Kishi et al.
5,850,243 A 12/1998 Kinoshita et al.
5,853,251 A 12/1998 Imai
5,862,753 A 1/1999 Dolan et al.
5,887,992 A 3/1999 Yamanashi
5,892,523 A 4/1999 Tanaka et al.
5,927,872 A 7/1999 Yamada
5,953,497 A 9/1999 Kokubo et al.
5,984,455 A 11/1999 Anderson
5,988,900 A 11/1999 Bobry
5,997,193 A 12/1999 Petteruti et al.
6,004,053 A 12/1999 Petteruti et al.
6,005,681 A 12/1999 Pollard
6,010,257 A 1/2000 Petteruti et al.
6,017,112 A 1/2000 Anderson et al.
6,062,686 A 5/2000 Kinoshita et al.
6,076,910 A 6/2000 Anderson
6,158,907 A 12/2000 Silverbrook et al.
6,164,853 A 12/2000 Foote
6,195,475 B1 2/2001 Beausoleil, Jr. et al.
6,203,221 B1 3/2001 Tomasik et al.
6,222,174 B1 4/2001 Tullis et al.
6,246,050 B1 6/2001 Tullis et al.
6,246,423 B1 6/2001 Suzuki et al.
6,249,360 B1 6/2001 Pollard et al.
6,259,826 B1 7/2001 Pollard et al.
6,261,011 B1 7/2001 Day et al.
6,270,187 B1 8/2001 Murcia et al.
6,270,271 B1 8/2001 Fujiwara
6,300,645 B1 10/2001 Bohn
6,303,921 B1 10/2001 Hastings et al.
6,312,124 B1 11/2001 Desormeaux
6,338,555 B1 1/2002 Hirose
6,347,897 B2 2/2002 Huggins et al.
6,357,939 B1 3/2002 Baron
6,364,550 B1 4/2002 Petteruti
6,367,993 B2 4/2002 Day et al.
6,373,995 B1 4/2002 Moore
6,379,058 B1 4/2002 Petteruti et al.
6,382,761 B1 5/2002 Asano et al.
6,394,674 B2 5/2002 Huggins et al.
6,398,432 B1 6/2002 Day et al.
6,409,401 B1 6/2002 Petteruti et al.
6,420,723 B2 7/2002 Bohn
6,429,422 B1 8/2002 Bohn
6,433,780 B1 8/2002 Gordon et al.
6,457,807 B1 10/2002 Hawkins et al.
6,481,905 B2 11/2002 Day et al.
6,503,005 B1 1/2003 Cockerill et al.
6,517,266 B2 2/2003 Saund
6,533,476 B2 3/2003 Hamisch, Jr. et al.
6,543,892 B2 * 4/2003 Kubota et al. ..... 347/109
6,543,893 B2 4/2003 Desormeaux
6,553,459 B1 4/2003 Silverbrook et al.
6,568,777 B1 5/2003 Andrerson et al.
6,572,290 B2 6/2003 McCleave et al.
6,583,895 B1 6/2003 Kuwahara et al.
6,604,874 B2 8/2003 Carriere et al.
6,607,316 B1 8/2003 Petteruti et al.
6,609,844 B1 8/2003 Petteruti et al.
6,623,191 B2 9/2003 Huggins et al.
6,626,593 B2 9/2003 Doberenz
6,626,597 B2 9/2003 Fujiwara
6,641,313 B2 11/2003 Bobry
6,648,528 B2 11/2003 Hardisty et al.
6,650,315 B2 11/2003 Murai
6,652,090 B2 11/2003 Silverbrook
6,663,222 B2 12/2003 Verhoest et al.
6,664,948 B2 12/2003 Crane et al.
6,674,543 B2 1/2004 Day et al.
6,686,910 B2 2/2004 O'Donnell, Jr.
6,742,887 B2 6/2004 Ando
6,846,119 B2 1/2005 Walling
2001/0019349 A1 9/2001 Kawakami
2001/0022914 A1 9/2001 Iura et al.
2001/0024586 A1 9/2001 Day et al.
2002/0033871 A1 3/2002 Kaiser
2002/0090241 A1 7/2002 Fujiwara
2002/0127041 A1 9/2002 Huggins et al.
2002/0154186 A1 10/2002 Matsumoto
2002/0158955 A1 10/2002 Hess et al.
2003/0031494 A1 2/2003 Cockerill et al.
2003/0063938 A1 4/2003 Hardisty et al.
2003/0117456 A1 6/2003 Silverbrook et al.
2004/0009024 A1 1/2004 Hardisty et al.
2004/0018035 A1 1/2004 Petteruti et al.

* cited by examiner

HANDHELD PRINTING WITH REFERENCE INDICIA

FIELD OF THE INVENTION

Generally, the present invention relates to handheld printers. Particularly, it relates to improving print quality in handheld printers of the type able to print in random motion patterns. In one aspect, reference indicia on media are used to relocate a lost printer position and/or update (validate) printer position while either inactive or actively printing. In another, particular types and styles of reference indicia are contemplated. Still other aspects relate to media having reference indicia and supply items with reference indicia for use with the media.

BACKGROUND OF THE INVENTION

As is known, handheld printers afford mobile convenience to users. Unlike their immobile or stationary counterparts, users determine the navigation path of a given swath of printing. In some instances, this includes random movement over a media. In others, it includes back-and-forth movement attempting to simulate a stationary printer. Regardless, successful handheld printing dictates that image information relative to the printer location be available at all times. However, all users do not navigate in the same fashion. Nor do they navigate at the same speed or orientation. For at least these reasons, handheld printers rely heavily on sensor inputs, such as those from optical sensors or encoders, for printing images. Yet, sensor inputs are sometimes limited in their capabilities and print jobs are interrupted due to lost or inaccurate printer location calculations.

In turn, if the printer location ever becomes lost, the printer can either quit printing or guess at location. If printing quits, users have incomplete print jobs. If locations are guessed, print quality suffers. In either, poor results are obtained. In the event printer locations are not completely lost, but simply inaccurate, print quality suffers because of inappropriately placed print patterns being deposited on the media.

Accordingly, there exists a need in the art for robust, multi-directional and random printing handheld printers having improved print quality. Particularly, there are needs by which handheld printers are able to validate or recalibrate positioning during printing and/or reacquire positioning to complete an interrupted or lost print job. Naturally, any improvements should further contemplate good engineering practices, such as relative inexpensiveness, stability, low complexity, ease of manufacturing, etc.

SUMMARY OF THE INVENTION

The above-mentioned and other problems become solved by applying the principles and teachings associated with the hereinafter described handheld printing with reference indicia. Specifically, methods and apparatus contemplate handheld printers manipulated randomly or predictably over a media on which an image is printed. In this regard, various reference indicia on the media serve to assist in reacquiring a lost printer position or validate/update other positions.

Representatively, a handheld printer includes one or more position sensors, a controller and an inkjet printhead that are coordinated to print an image. Also, the controller correlates the location of the printhead to the image and, when lost, communicates to a direction indicator of the printer to provide user notification of where to move the housing to reacquire the location. Especially, the direction indicator points to the location of a reference indicia on the media. Once over the reference indicia, the printer reads or views the information therein and location is reacquired. Embodiments of the reference indicia include guide and location patterns, with the guide pattern pointing to the location pattern. The reference indicia is variously provided, but representatively includes being printed by the printer as printing operations begin, being pre-printed on the media or applied to the media as a supply item.

For validating or recalibrating other than completely lost positions, reference indicia representatively include related tick marks of substantially equal size and shape with substantially equal spacing there between.

Supply items for applying reference indicia on the media include a substrate with reference indicia thereon. The substrate has a planar size substantially smaller than the media. The reference indicia is also pre-selected to substantially match a reference indicia stored in the printer.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE PREFERRED EMBODIMENTS

In the following detailed description of the preferred embodiments, reference is made to the accompanying drawings that form a part hereof, and in which is shown by way of illustration, specific embodiments in which the invention may be practiced. These embodiments are described in sufficient detail to enable those skilled in the art to practice the invention and like numerals represent like details in the various figures. Also, it is to be understood that other embodiments may be utilized and that process, mechanical, electrical and/or other changes may be made without departing from the scope of the present invention. In accordance with the present invention, a handheld printer for printing with reference indicia is hereafter described.

Figure 1:
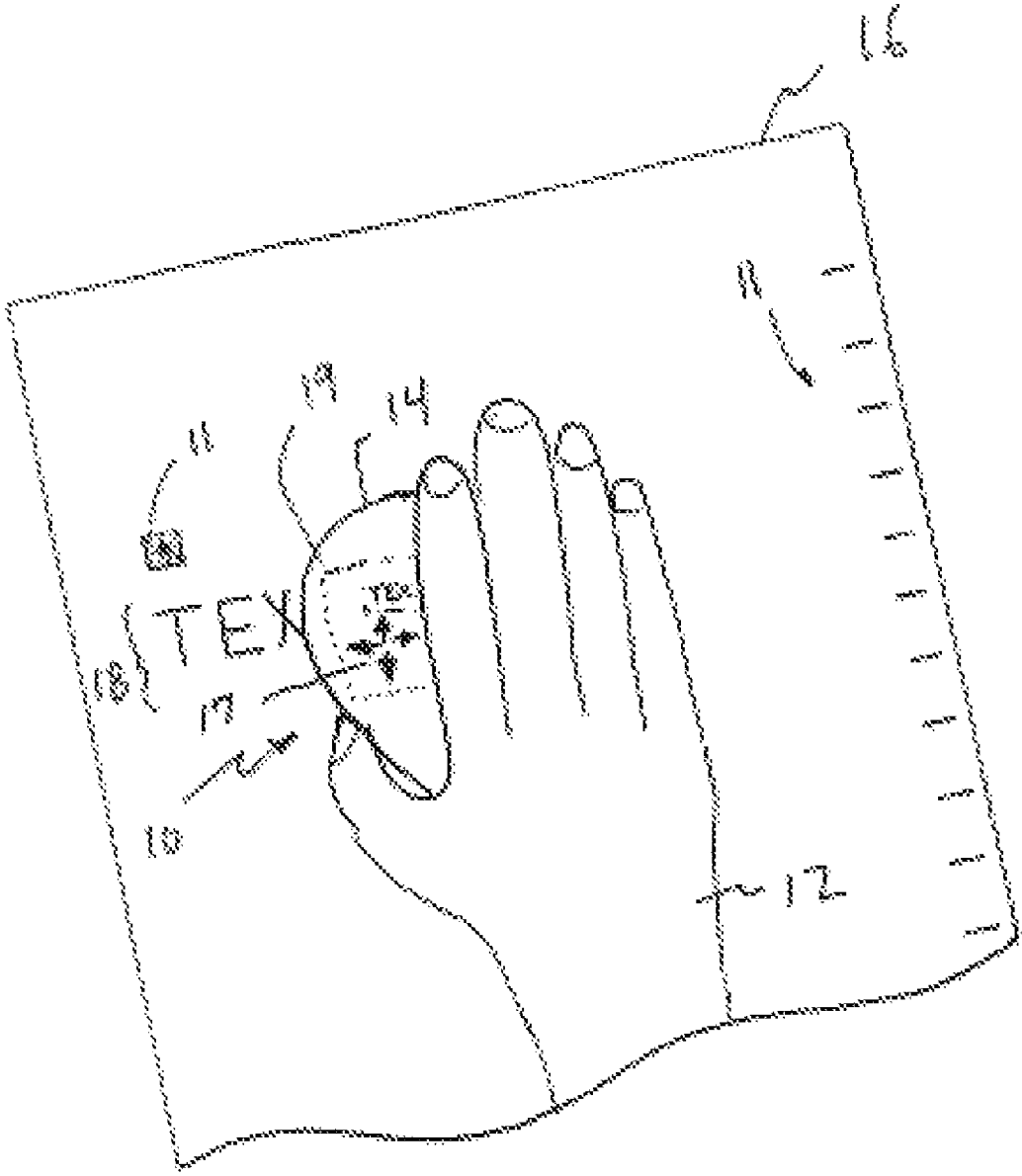
FIG. 1 is a diagrammatic view in accordance with the present invention of a handheld printer.

With reference to FIG. 1, a handheld printer of the invention for printing with one or more reference indicia 11 is given generically as 10. It includes a housing 14 that an operator 12 maneuvers or manipulates back and forth over a media 16 to print an image 18. In various embodiments, the image is text, figures, combinations of text and figures or the like. They are typified in color and/or black and white. Also, the printer optionally includes position indicators 17 that, as will be seen below, notify users where to move the housing to pass over the reference indicia to reacquire a lost printer position or validate an existing position. The indicators are representatively given as arrows and may be found electronically as part of a viewable display panel 19 (dashed line) or physically as structures, such as lighted buttons.

Figure 2:
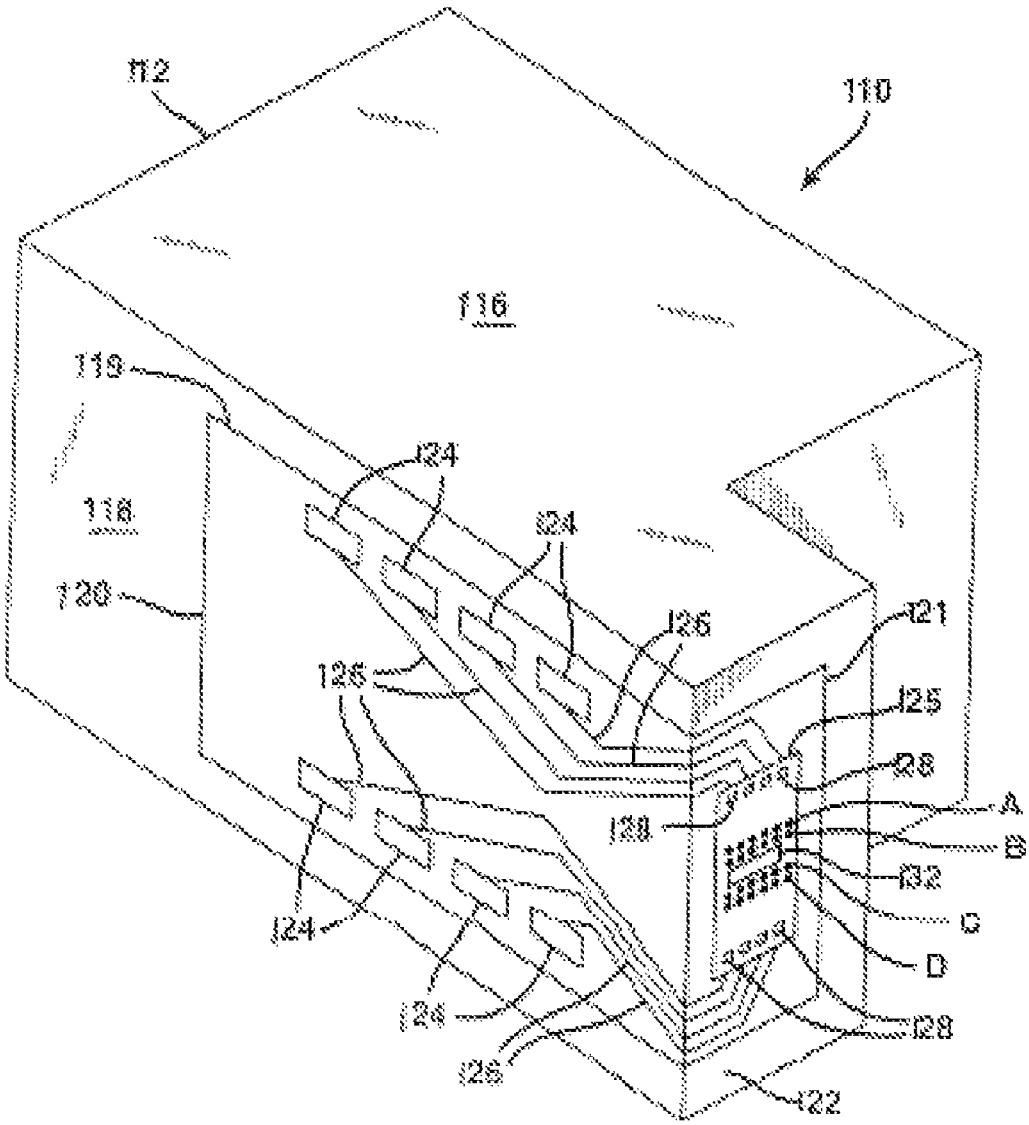
FIG. 2 is a diagrammatic view in accordance with the present invention of a representative inkjet printhead for use in the handheld printer of FIG. 1.

In FIG. 2, an inkjet printhead of the printer internal to the house [14] is shown generally as 110. It includes its own housing 112 having a shape that depends upon the shape of the printer. The housing has at least one internal compartment 116 for holding an initial or refillable supply of ink. In one embodiment, the compartment contemplates a single chamber holding a supply of black, cyan, magenta or yellow ink. In other embodiments, it contemplates multiple chambers containing multiple different colored inks. In one instance, it includes supplies of cyan, magenta and yellow ink. In still other embodiments, it includes plurals of black, cyan, magenta and/or yellow ink. It will be appreciated, however, that while the compartment 116 is shown as locally integrated within a housing 112 of the printhead, it may alternatively be separable from the housing 112 and/or printhead 110, for example.

At once surface 118 of the housing 112 is a portion 119 of a flexible circuit, especially a tape automated bond (TAB) circuit 120. At 121, another portion 121 is adhered to surface 122. Electrically, the TAB circuit 120 supports a plurality of input/output (I/O) connectors 124 for connecting an actuator chip 125, also known as a heater chip, to the handheld printer during use. Pluralities of electrical conductors 126 exist on the TAB circuit to connect and short the I/O connectors 124 to the input terminals (bond pad 128) of the actuator chip 125 and skilled artisans know various techniques for facilitating this. In an exemplary embodiment, the TAB circuit is a polyimide material and the electrical conductors and connectors are copper or aluminum-copper. For simplicity, FIG. 2 shows eight I/O connectors 124, electrical conductors 126 and bond pads 128 but present day printhead have larger quantities and any number is equally embraced herein. Also, skilled artisans will appreciate that the number of connectors, conductors and bond pads, while shown as equal to one another, may vary unequally in actual embodiments.

At 132, the actuator chip 125 contains at least one ink via that fluidly connects to the ink of the compartment 116. During printhead manufacturing, the actuator chip 125 is attached to the housing with any of a variety of adhesives, epoxies, etc., as is well know in the art. To eject ink, the actuator chip contains columns (column A-column D) of fluid firing actuators, such as thermal heaters. In other actuator chips, the fluid firing actuators embody piezoelectric elements, MEMs devices, and the like. In either, this crowded figure simplifies the actuators as four columns of six dots or darkened circles but in practice the actuators might number several dozen, hundred or thousand. Also, vertically adjacent ones of the actuators may or may not have a lateral spacing gap or stagger there between. In general, however, the actuators have vertical pitch spacing, such as about $1/300^{th}$, $1/600^{th}$, $1/1200^{th}$, or $1/2400^{th}$ of an inch along the longitudinal extent of a via. Further, the individual actuators are typically formed as a series of thin film layers made via growth, deposition, masking, patterning, photolithography and/or etching or other processing steps on a substrate, such as silicon. A nozzle member with pluralities of nozzle holes, not shown, is adhered to or fabricated as another thin film layer on the actuator chip such that the nozzle holes generally align with and are positioned above the actuators to eject ink.

Figure 3:
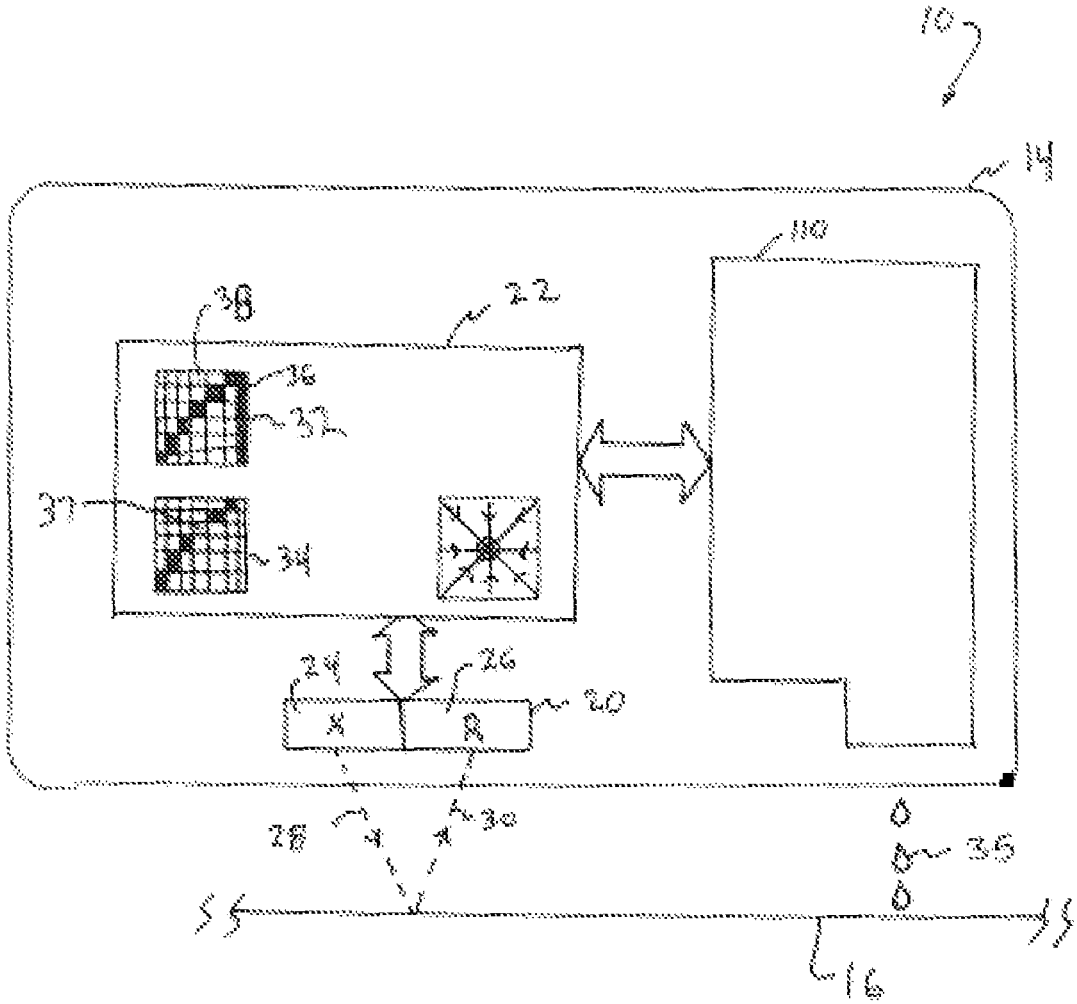
FIG. 3 is a diagrammatic view in accordance with the present invention of a representative arrangement of a handheld printer for printing with reference indicia.

With reference to FIG. 3, a greatly exaggerated view of the handheld printer 10 shows a position sensor 20 and a controller 22. The position sensor, preferably of the optical type, includes a transmitter 24 and a receiver 26 that together shine light 28 and capture reflections 30 from the media 16. In this manner, the position or location of the housing, especially printhead 110 is made known at the controller regardless of random or predictable movement of the housing 14 by an operator.

Among other things, the controller 22 also includes a stored to-be-printed representation of an image 32. In turn, it correlates the position of the printhead, especially individual actuators, to the image. It then prints the image with ink 35 on the media 16 according to the image pattern 36 in the pixels 38. A has-been-printed image 34 may also be stored or accessed by the controller to keep track of future printing and to determine whether the image has been printed completely or not. In structure, the controller embodies an ASIC, discrete IC chips, firmware, software, a microprocessor, combinations thereof or the like. Alternatively, the to-be-printed image 32 is dynamically updated to remove pixels that have been printed so that the has-been printed information 34 is merged with the to-be-printed information. In either, the controller further includes a memory stored reference indicia 39 for comparison, in some instances, to the reference indicia of the media to reacquire a lost printer position or validate other than lost positions.

Figure 4:
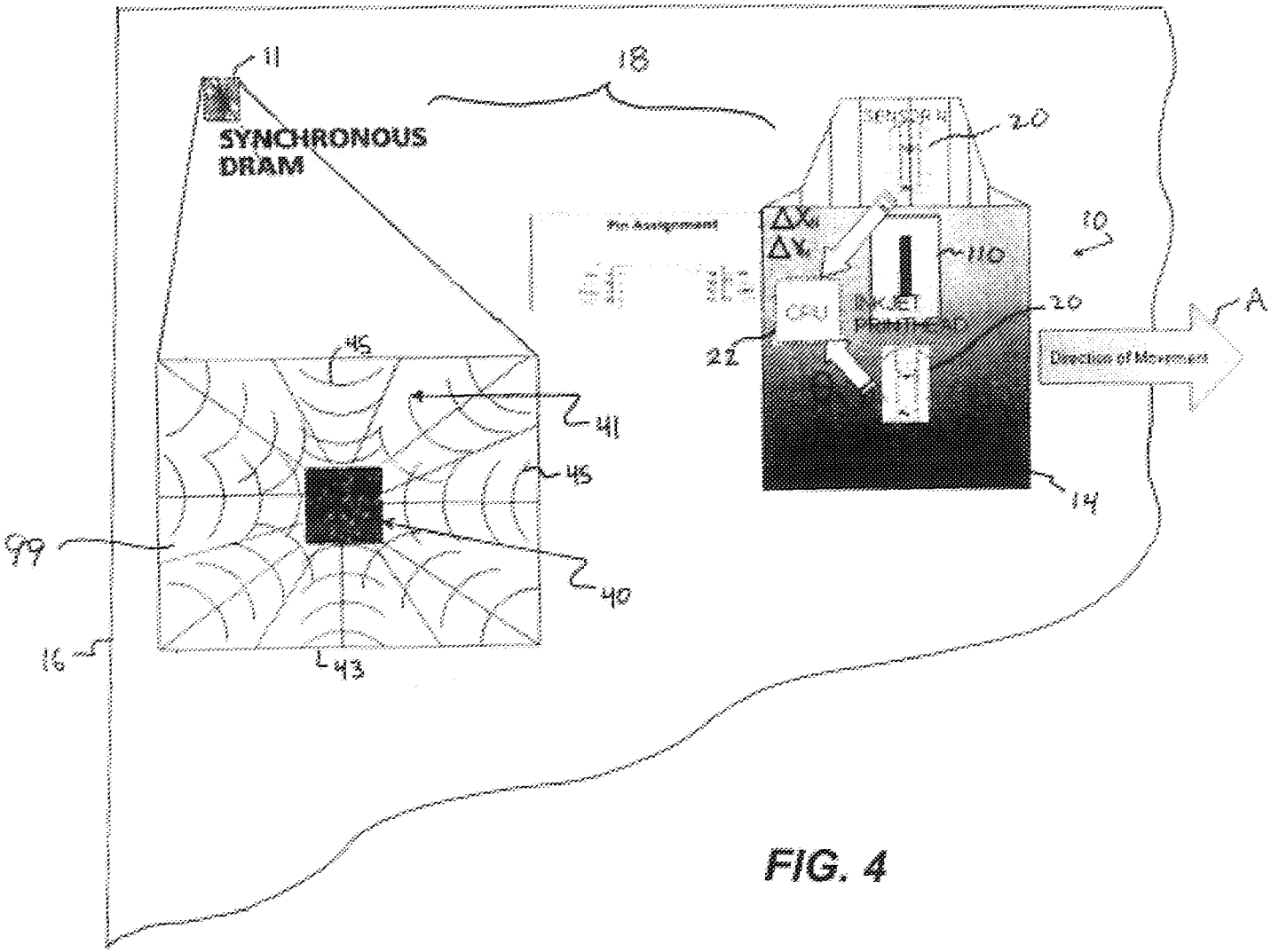
FIG. 4 is a diagrammatic view in accordance with the present invention of a representative reference indicia for sue in reacquiring printer location.

With reference to FIG. 4, a handheld printer 10 is being maneuvered over a media 16 in the direction of the arrow A to print and image 18 (representatively given as a Synchronous DRAM specification sheet). Near the image, as practicably as possible, is a reference indicia 11 in the form of an icon 99. In a variety of way, the reference indicia is provided on the media. In the first, it is provided by printing from the handheld printer 10, such as before printing the image 18. In the second, it is provided as a pre-printed media sheet. In the third, it is provided as a supply item for applying to the media. In may even occur as the result of a combination of the foregoing. As provided below with reference to other figures, the details of the pre-printed media and the supply item will be furnished.

Regardless of how obtained, the inset shows a magnified representative of the reference indicia including both a location pattern 40 and a guide pattern 41. As is seen, the location pattern is generally central to the reference indicia periphery 43 while the guide pattern 41 surrounds the location pattern. The guide pattern also includes indicators 45, such as arcs or chevrons, which are used in combination with the optical sensor(s) 20 to direct the printer, especially sensors, over at least a portion of the location pattern. In this manner, once the sensor can observe the location pattern and communicate same with the controller 22, including comparison to the stored reference indicia (FIG. 3), the printer location can be reacquired after being lost, for example, during a print job.

Normal printing occurs by returning the printer to the unfinished portion of the to-be-printed image.

Figure 5:
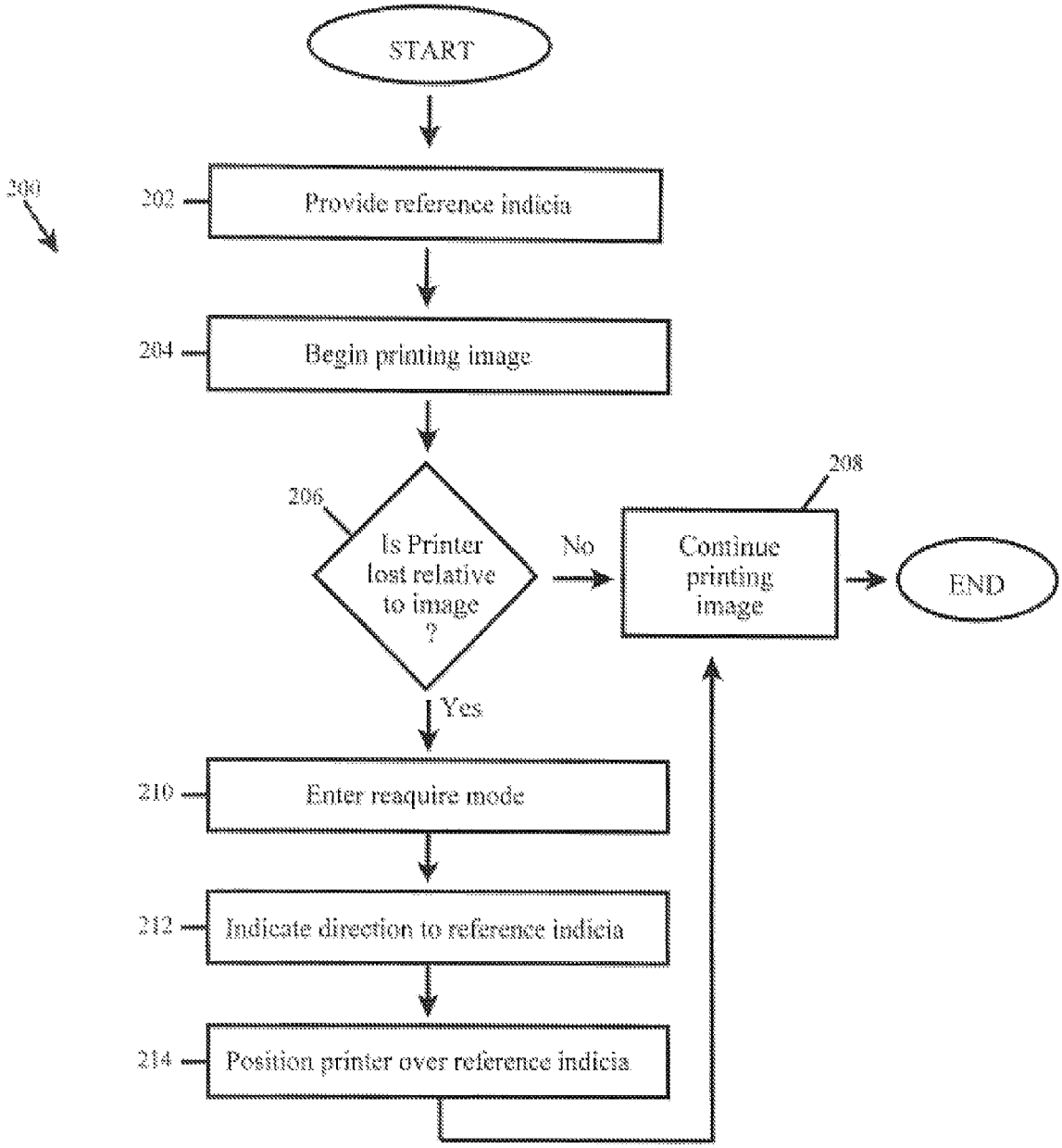
FIG. 5 is a flow chart in accordance with the present invention of a representative method for printing with reference indicia.

With reference to FIG. 5, a method for printing with a handheld printer utilizing reference indicia is given as 200. At step 202, the reference indicia is provided on the media. As before, this can occur via printing with the printer, application of a supply item to the media, or by way of a pre-printed media. At step 204, the printing of the image begins. Naturally, this includes a user maneuvering the printer over the media and a controller correlating the image to fluid firing actuators for operation. Such is also done via the assistance of the inputs from the sensors, especially in ascertaining printer velocity or speed and ongoing changes in x and y positions of the printhead relative to the media and observing angular orientations (θ). Thereafter, determinations (regular, ongoing, continuous, irregular, random, etc.) are made at step 206 regarding the printer location relative to the image. If the printer location is known, printing of the image continues at step 208 until the image is fully printed.

If the printer location is unknown, or lost, a reacquisition mode of printing is entered at step 210. In this regard, it is preferred that printing of the image ceases so that poor print quality will not result. Then, at step 212, directions to the reference indicia are indicated. In this regard, the position indicators 17 (FIG. 1) are displayed to show the way to the reference indicia. Intuitively, if a reference indicia is printed on the media before printing of the image, for example, it is preferred that the indicia be so small as to avoid visual detraction from the image. Thus, it should be appreciated that the reference indicia may be so small that users do not even know of its existence and need directions to its location. In some instances, the area of reference indicia is contemplated on the order of a few $mm^2$.

Next, users follow the position indicators until the printer is eventually positioned over the reference indicia, step 214. Automatically, the controller will then observe the reference indicia, especially the location pattern, and reacquire the location of the printer. Normal printing of the image then occurs by moving the printer back to a position on the media requiring printing, step 208. Eventually, the complete image is fully printed.

Figure 6:
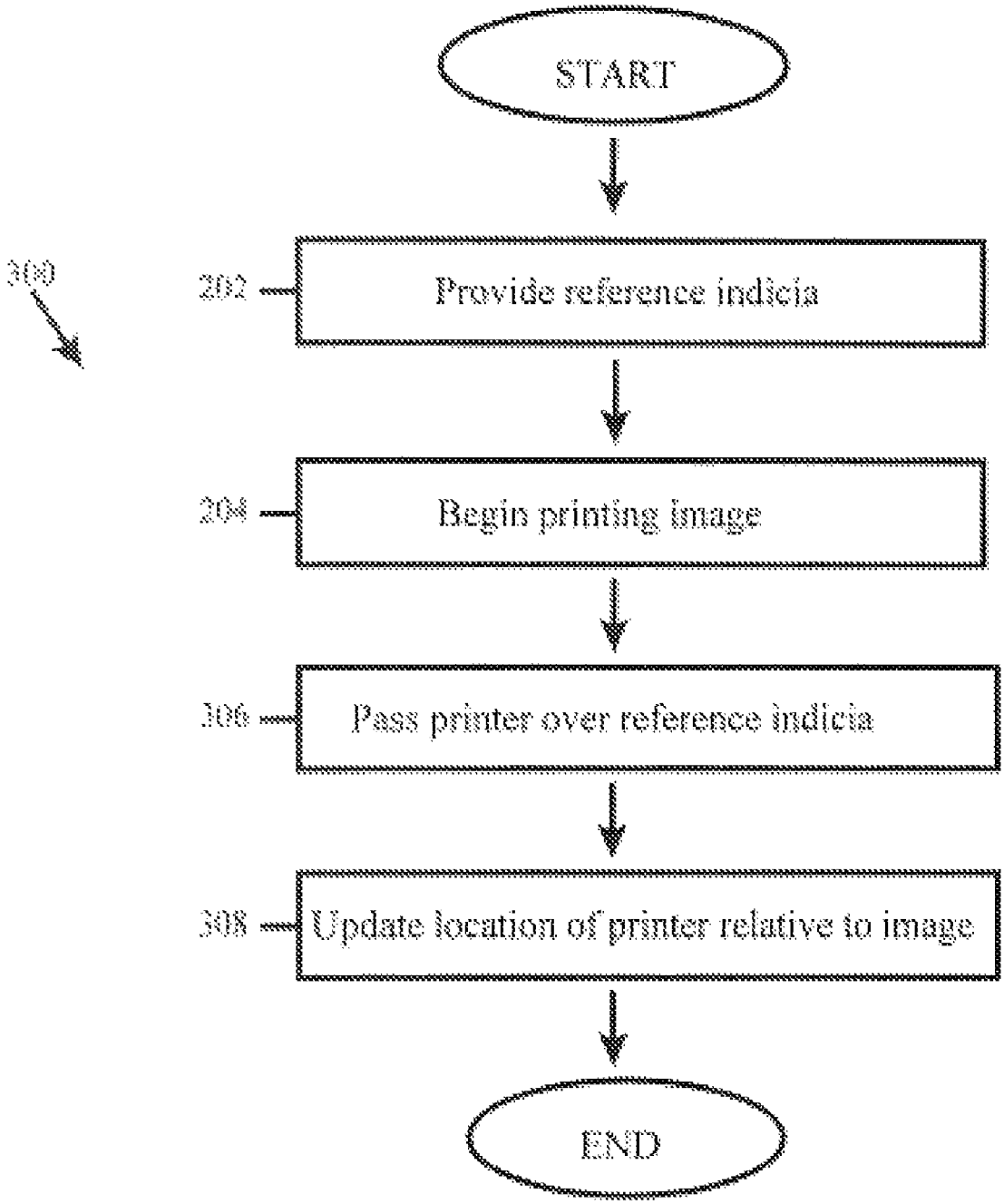
FIG. 6 is a flow chart in accordance with the present invention of an alternate embodiment for printing with reference indicia.

With reference to FIG. 6, reference indicia can be further used according to process 300. That is, a reference indicia is provided on the media and printing of the image begins at steps 202 and 204, as before. At step 306, however, the printer is passed or traversed over the reference indicia during normal printing operations and the location of the printer relative to the image is updated or validated at step 308. In this regard, reference indicia can be positioned on the media in known locations near the image such that users can regularly pass the printer over the indicia without stopping printing jobs and the current location of the printer be updated if slightly off (e.g., recalibrated) or validated if accurate.

Figure 7A:
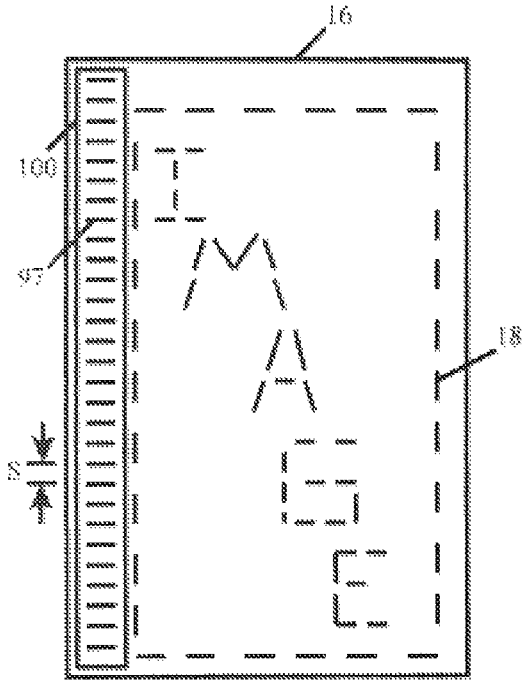
FIGS. 7A-7G are diagrammatic views in accordance with the present invention of a representative media and/or supply item with reference indicia for use in handheld printing.

For example, FIG. 7A shows a media 16 for printing an image with reference indicia 11 along a length dimension. The reference indicia includes a plurality of related marks 97, in this case tick marks, of substantially equal size, shape and spacing S. During use, when an operator prints and image 18 (dashed line) they can regularly traverse over the reference indicia to update or validate printer position. For instance, as the printer travels during image printing, it keeps track of the printer location relative to the image. Then, upon passing over any given mark 97, the controller expects to see a mark in the nearby vicinity. Upon seeing a mark, it can then update its position if off, or validate its position if accurate. In either, fine-tuning of positional information is obtained.

Figure 8:
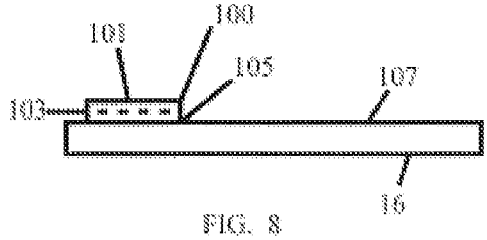
FIG. 8 is a cross section view in accordance with the present invention of a representative supply item with reference indicia for use with media in handheld printing.

Also, FIG. 7A shows another feature of the invention in the form of a supply item 100 for use with the media 16. In this regard, a substrate 103 (FIG. 8) with a reference indicia 101 embossed, printed, engraved, etc., overlays a surface 107 of the media 16. Preferably, it removably overlays the substrate so that, upon completion of printing the image, the substrate 103 can be removed. In various embodiments, the substrate is single- or multi-layered including an adhesive 105 for permanently or semi-permanently attaching to the substrate. For semi-permanently attachment a weak adhesive is contemplated while permanent attachment contemplates strong adhesives. In either, the composition of the substrate includes of a variety of materials including paper, plastic, metal, and combinations. Packaging of the items can also occur as one or more lengthy strips, such as seen in FIG. 7A, or as a roll with perforated sections for tearing strips apart. Of course, other embodiments are possible.

Figure 7B:
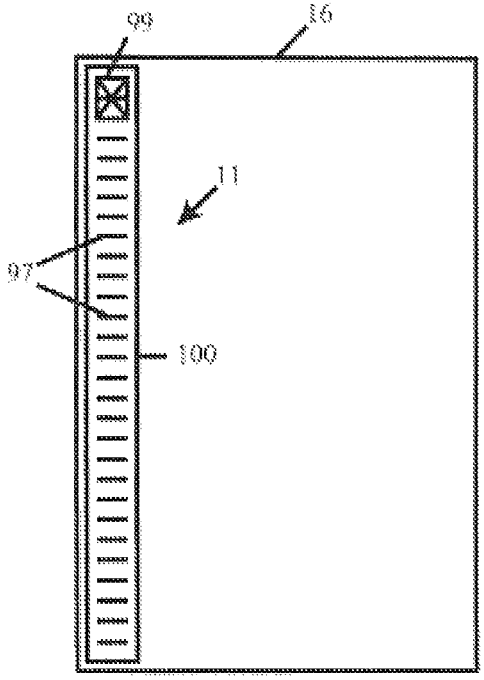

Alternatively, FIG. 7B shows a reference indicia 11 on a media 16 for use in handheld printing with both multiple related marks 97 and an icon 99, of the type described in FIG. 4 with both guide and location patterns thereon. In this manner, both absolute and relative printer positions are learned from the reference indicia. The absolute printer position occurs (similar to the example of FIG. 4) with a guide pattern pointed toward a location pattern that the printer passes over to locate the starting point of printing and for reacquiring position if lost. The relative printer position occurs by regularly passing the printer over the marks 97 during a print job and this helps maintain calibration of the printer.

Figure 7C:
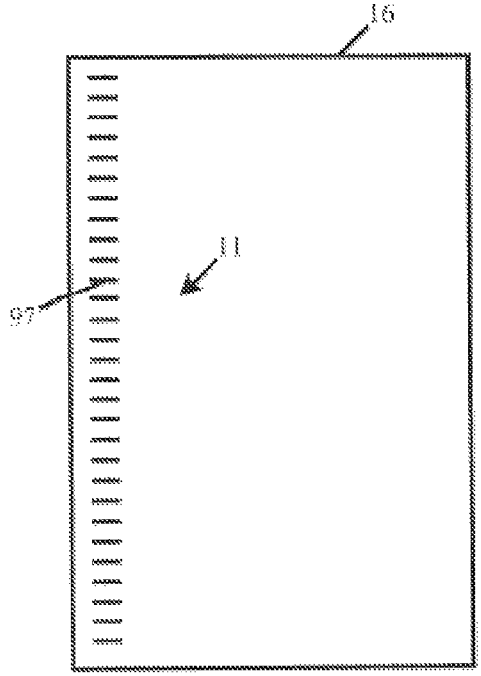
Figure 7D:
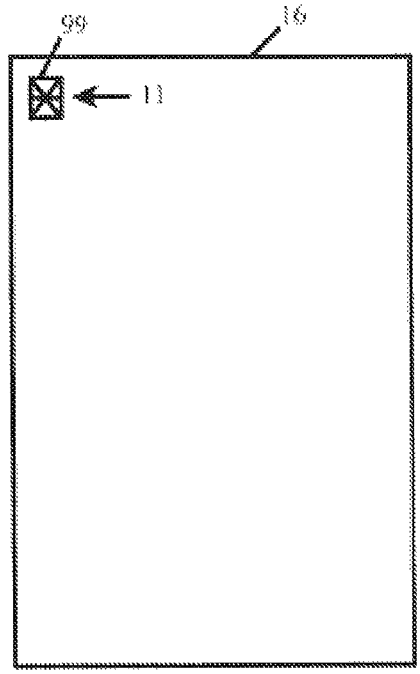
Figure 7E:
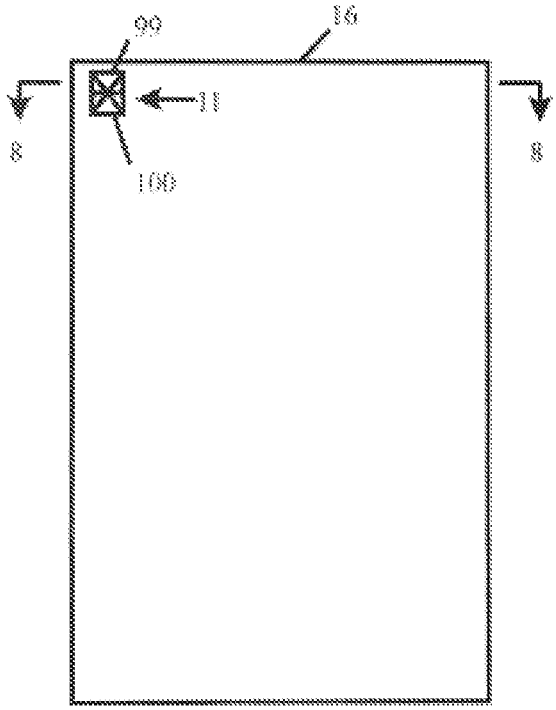
Figure 7F:
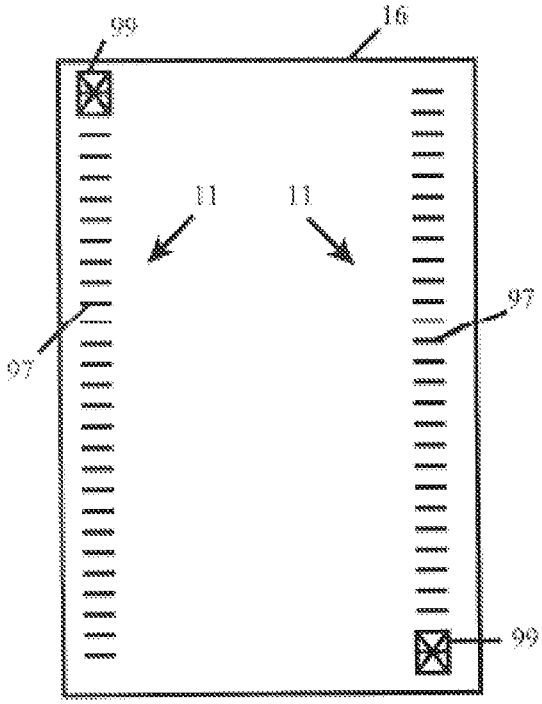
Figure 7G:
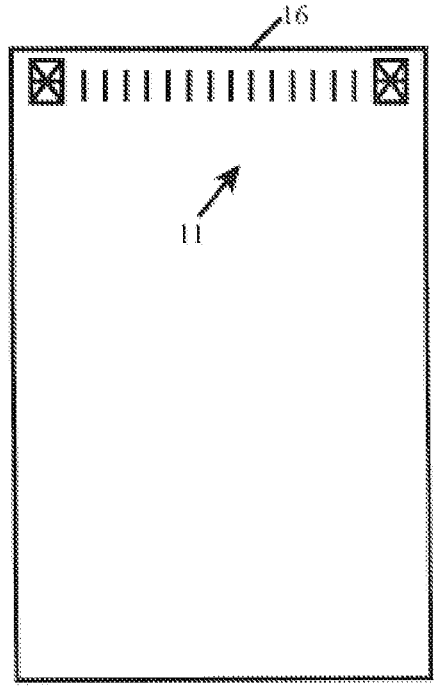

In still other alternate embodiments, FIG. 7E shows the supply item 100 simply as the reference indicia 11 in the exclusive form of the icon 99. For packaging, this too may be in a roll form or as a plurality of stamp-like substrates. In FIGS. 7C and 7D, no longer is the reference indicia 11 provided as a supply item, but simply adorned on the media 16. It is contemplated that the reference indicia 11 (as a singular embodiment of related marks 97 or as an icon 99, or as a combination of both) will be printed on the media, but alternatively may be embossed, etched, engraved, deposited, or the like. In FIG. 7F, the notion of more than one reference indicia is given as reference indicia 11 on both long sides of the media 16. It is also shown in this embodiment that the reference indicia can be a composite indicia with both marks 97 and an icon 99. Of course, it can further be one or the other. In FIG. 7G, the notion that the reference indicia 11 for use with handheld printing can appear anywhere on the media 16 is given. As seen, a reference indicia 11 appears on a single, short side of the media. Naturally, skilled artisans can contemplate other embodiments and combinations of the foregoing are especially embraced herein.

In any embodiment, certain advantages of the invention over the prior art are readily apparent. For example, the invention at hand provides updating/validating printer positioning during printing or reacquiring positioning, if lost, to complete an interrupted print job. Alternatively, the invention contemplates supply items for application to media or pre-adorned media with reference indicia for use with handheld printing. Less intuitively, use of reference indicia during handheld printing minimizes accumulated position errors. Better print quality then results. Also, because simple reference indicia can assist in printing, robustness is added and manufacturing costs are minimized.

Finally, one of ordinary skill in the art will recognize that additional embodiments are also possible without departing from the teachings of the present invention. This detailed description, and particularly the specific details of the exemplary embodiments disclosed herein, is given primarily for clarity of understanding, and no unnecessary limitations are to be imported, for modifications will become obvious to those skilled in the art upon reading this disclosure and may be made without departing from the spirit or scope of the invention. Relatively apparent modifications, of course, include combining the various features of one or more figures with the features of one or more of other figures.

What is claimed is:

1. A method of printing an image with a handheld printer, comprising:

providing a reference indicia on a media, the reference indicia including a location pattern and a guide pattern;

determining whether the printer is lost relative to the image; and if lost, directing the printer towards the location pattern by using the guide pattern of the reference indicia and positioning the printer thereon to reacquire printer location.

2. The method of claim 1, further including, providing an integrated display panel on the handheld printer with position indicators therein to facilitate movement of the printer, wherein if the printer is lost, the position indicators indicating a direction of printer travel to the reference indicia.

3. The method of claim 2, wherein providing the position indicators within the display panel further including a plurality of arrows showing direction of the printer travel when the printer is lost.

4. The method of claim 1, further including, if lost, entering a mode of printer operation having no printing.

5. The method of claim 1, wherein the providing the reference indicia further includes printing the reference indicia on the media.

6. The method of claim 1, wherein the providing the reference indicia further includes laying the reference indicia on the media.

7. The method of claim 6, wherein the laying the reference indicia on the media further includes adhering the reference indicia to the media.

8. The method of claim 1, wherein the providing the reference indicia further includes obtaining the media with the reference indicia already printed.

9. A method of printing an image with a handheld printer to be manipulated back and forth by an operator during use, comprising:

providing a media;

providing a reference indicia on the media with a location pattern and a guide pattern; and using the guide pattern of the reference indicia to direct the printer to the location pattern of the reference indicia to reacquire printer location.

10. The method of claim 9, further including determining whether the printer is lost relative to the image before the using the guide pattern.

11. The method of claim 9, further including providing an integrated display panel on the handheld printer with position indicators therein to facilitate movement of the printer, wherein the positional indicators indicating a direction of printer travel to the reference indicia.

12. The method of claim 11, wherein providing the position indicators within the display panel further including a plurality of arrows showing direction of the printer travel when the printer is lost.

13. The method of claim 9, further including entering a mode of printer operation having no printing during the using the guide pattern.

14. The method of claim 9, wherein the providing the reference indicia further includes printing the reference indicia on the media.

15. The method of claim 9, wherein the providing the reference indicia further includes obtaining the media with the reference indicia already printed.

* * * * *